US008215737B2

(12) United States Patent
Hiwada

(10) Patent No.: US 8,215,737 B2
(45) Date of Patent: Jul. 10, 2012

(54) DEMODULATOR FOR RECORDING HEAD, DATA TRANSFER UNIT FOR RECORDING HEAD AND RECORDING APPARATUS

(75) Inventor: Shuhei Hiwada, Toyoake (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 465 days.

(21) Appl. No.: 12/567,917

(22) Filed: Sep. 28, 2009

(65) Prior Publication Data

US 2010/0079520 A1 Apr. 1, 2010

(30) Foreign Application Priority Data

Sep. 30, 2008 (JP) ..... 2008-253368

(51) Int. Cl.
*B41J 29/38* (2006.01)

(52) U.S. Cl. ..... 347/10

(58) Field of Classification Search ..... 347/10, 347/135

See application file for complete search history.

(56) References Cited

U.S. PATENT DOCUMENTS 5,126,754 A * 6/1992 Spinar et al. ..... 346/29
5,134,512 A * 7/1992 Hiwada ..... 359/196.1
5,145,946 A * 9/1992 Fujii et al. ..... 528/388
5,696,593 A * 12/1997 Chiba et al. ..... 358/296
6,467,863 B1 10/2002 Imanaka et al.
6,731,317 B2 * 5/2004 Ema et al. ..... 347/135
7,155,972 B2 * 1/2007 Kosugi ..... 73/290 V
7,232,209 B2 * 6/2007 Asauchi ..... 347/86
7,695,084 B2 * 4/2010 Kawauchi ..... 347/10
2008/0007578 A1 * 1/2008 Takimoto ..... 347/6

FOREIGN PATENT DOCUMENTS

JP 8-309974 11/1996
JP 2001-47630 2/2001
JP 2007-136258 6/2007

* cited by examiner

*Primary Examiner* — Charlie Peng
(74) *Attorney, Agent, or Firm* — Frommer Lawrence & Haug LLP

(57) ABSTRACT

A demodulator for recording head includes a reference-clock input section to which a reference clock is inputted; a modulated-signal input section to which a plurality of types of modulated signals generated by modulating a plurality of types of recording signals corresponding to a plurality of types of jetting modes of the recording head are inputted; a demodulation-clock generating circuit which generates from the reference clock, a demodulation clock for detecting the timing at which the value of the modulated signal changes; and a demodulator circuit which demodulates the modulated signal to the recording signal by detecting the timing, at which the value of the modulated signal changes, by using the demodulation clock, and the plurality of types of modulated signals have different timings, based on the reference clock, at which values of the modulated signals change, respectively.

14 Claims, 13 Drawing Sheets

45a
10
45
42
(41,40)
43
44a
44b
44c
44
VI
V
15

10
40
43
15

10
41
44a
44b
44c
44
15

45a
10
42
45
15
SCANNING DIRECTION
PAPER FEEDING DIRECTION

TIME

DEMODULATOR FOR RECORDING HEAD, DATA TRANSFER UNIT FOR RECORDING HEAD AND RECORDING APPARATUS

CROSS REFERENCE TO RELATED APPLICATION

The present application claims priority from Japanese Patent Application No. 2008-253368, filed on Sep. 30, 2008, the disclosure of which is incorporated herein by reference in its entirety.

BACKGROUND OF THE INVENTION

1. Field of the Invention

The present invention relates to a demodulator for recording head, a data transfer unit for recording head which are used for a transfer of a recording signal in a recording head and a recording apparatus in which the data transfer unit is included.

2. Description of the Related Art

In an ink-jet recording apparatus disclosed in Japanese Patent Application Laid-open No. H08-309974, a clock (CLK, reference clock) and a data signal (DATA) in which redundant data is added to recording data are inputted from a control circuit to a drive circuit. The data signal is serially transferred upon synchronizing with the clock. Accordingly, even when a noise is superimposed to the clock or the data signal, it is possible to detect an error in the recording data. Moreover, when the error of the recording data is detected, the data signal is transferred once again.

In such a recording apparatus disclosed in Japanese Patent Application Laid-open No. H08-309974, since the data signal is serially transferred upon synchronizing with the clock, as in a case in which an image to be recorded in the recording apparatus is subjected to be a high resolution image, it can be considered to increase a frequency of clock and to increase the number of signal wires for transferring the data signal in order to transfer more data signals in a predetermined time period. However, when the frequency of the clock is increased, there is a possibility that a radiated noise becomes substantial, and when the number of signal wires for transferring the data signal is increased, there is a possibility that the size of the recording apparatus becomes large, and that a manufacturing cost increases.

SUMMARY OF THE INVENTION

An object of the present invention is to provide a demodulator for recording head, a data transfer unit for recording head, which are capable of transferring recording data efficiently and a recording apparatus in which the data transfer unit is included.

According to a first aspect of the present invention, there is provided a demodulator for recording head including a reference-clock input section to which a reference clock is inputted; a modulated-signal input section to which a plurality of types of modulated signals generated by modulating a plurality of types of recording signals corresponding to a plurality of types of jetting modes of the recording head are inputted; a demodulation-clock generating circuit which generates from the reference clock, a demodulation clock for detecting the timing at which the value of the modulated signal changes; and a demodulator circuit which demodulates the modulated signal to the recording signal by detecting the timing, at which the value of the modulated signal changes, by using the demodulation clock, and the plurality of types of modulated signals have different timings, based on the reference clock, at which values of the modulated signals change, respectively.

According to a second aspect of the present invention, there is provided a data transfer unit for recording head including a modulator which modulates a plurality of types of recording signals corresponding to a plurality of types of recording modes of a recording head to a plurality of types of modulated signals; and a demodulator which demodulates the modulated signals modulated in the modulator to the recording signals, and the modulator has a modulation-clock generating circuit which generates a modulation clock from a reference clock, and a modulation circuit which modulates the plurality of types of recording signals to a plurality of types of modulated signals having different timings, based on the reference clock, at which values of the modulated signals change, by using the modulation clock, and the demodulator has a demodulation-clock generating circuit which generates a demodulation clock for demodulating the modulated signal from the reference clock, and a demodulation circuit which demodulates the modulated signal to the recording signal by detecting a timing, at which a value of the modulated signal changes, using the demodulation clock.

According to a third aspect of the present invention, there is provided a recording apparatus including: the data transfer unit for recording head as defined in the second aspect described above; and a recording head for recording based on the recording signals modulated and demodulated in the data transfer unit.

According to the first, second and third aspects of the present invention, since it is possible to demodulate the modulating signal by detecting the timing at which the value of the modulating signal changes, by using the demodulation clock generated from the reference clock, it is possible to transfer larger number of jetting signals without increasing a frequency of the reference clock and the number of signal wires.

DETAILED DESCRIPTION OF THE PREFERRED EMBODIMENTS

A first embodiment in which the present invention is applied to an ink-jet printer will be described below.

Figure 1:
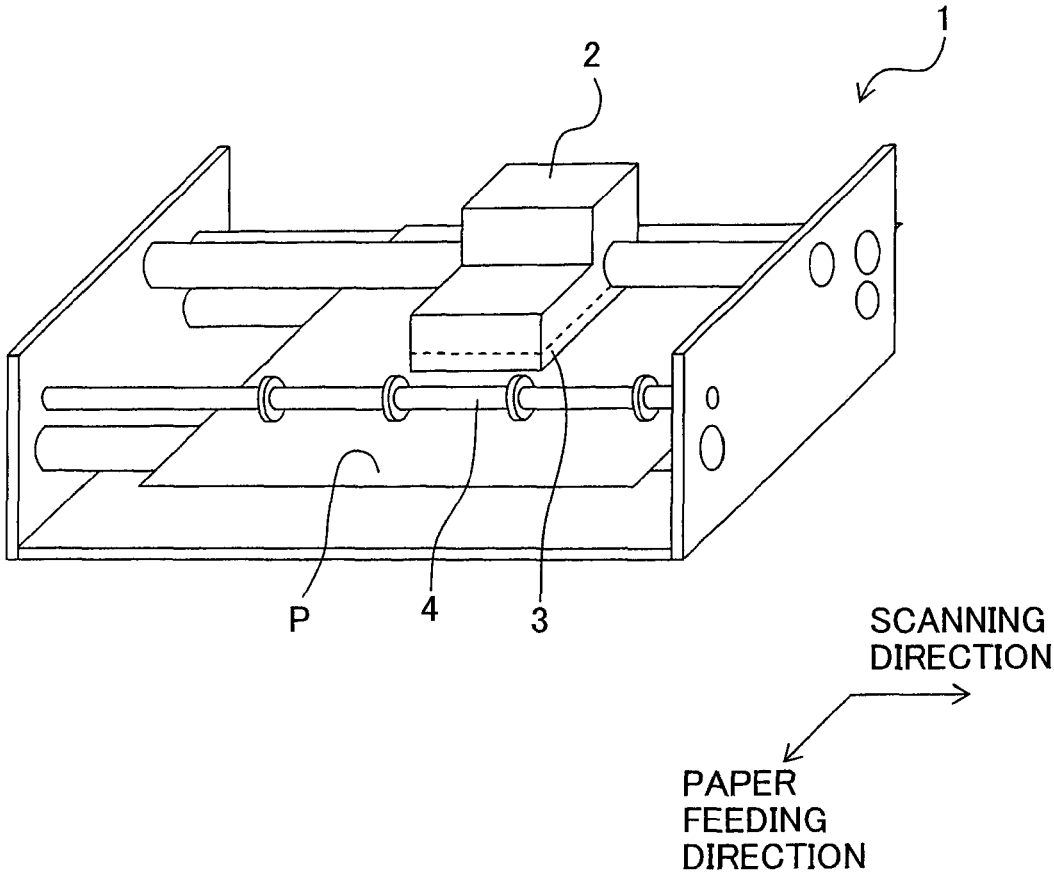
FIG. 1 is a schematic structural view of a printer according to a first embodiment.
Figure 2:
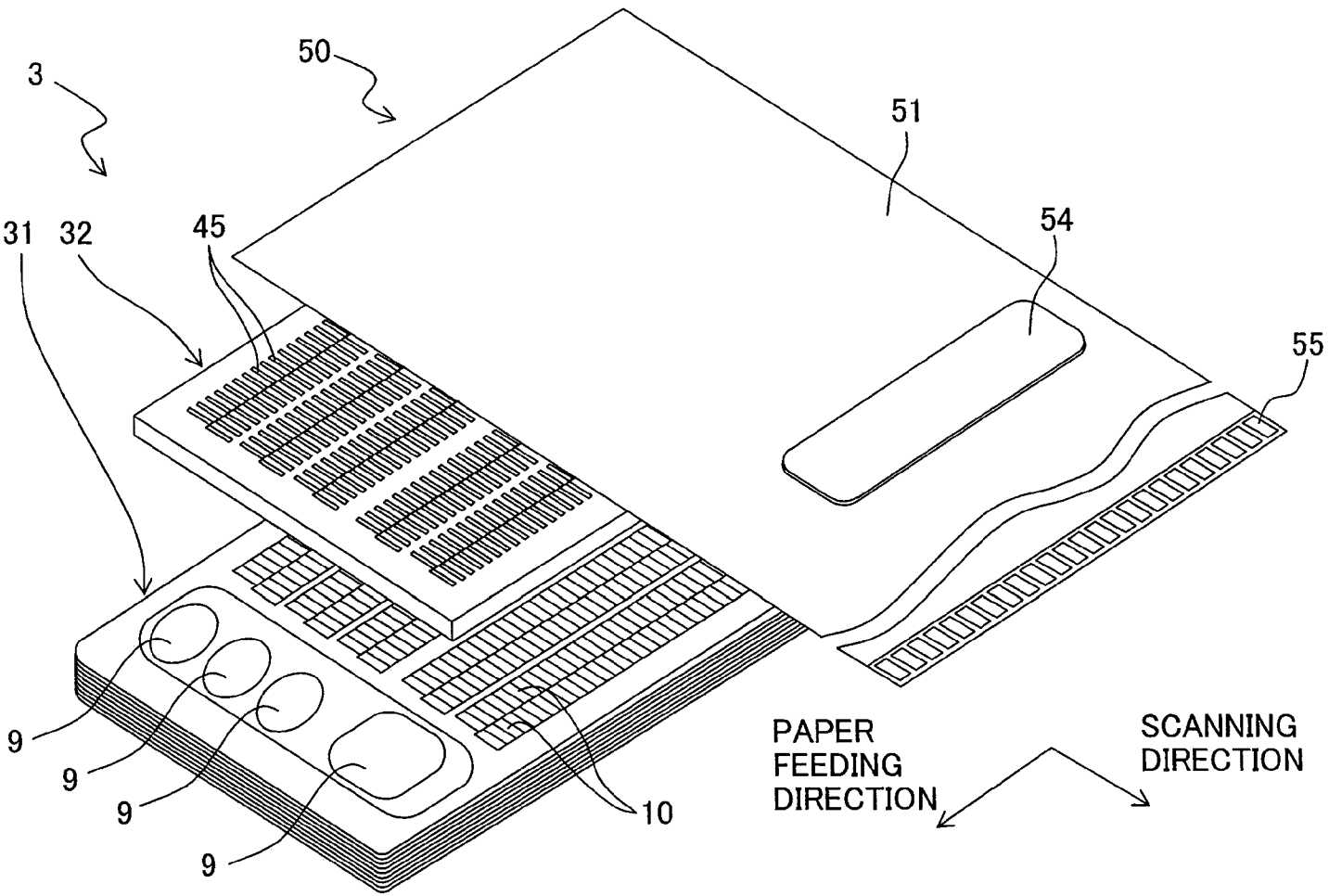
FIG. 2 is a perspective view of an ink-jet head.

As shown in FIG. 1, an ink-jet printer 1 includes a carriage 2, and ink-jet head 3, and a paper transporting roller 4.

Figure 5:
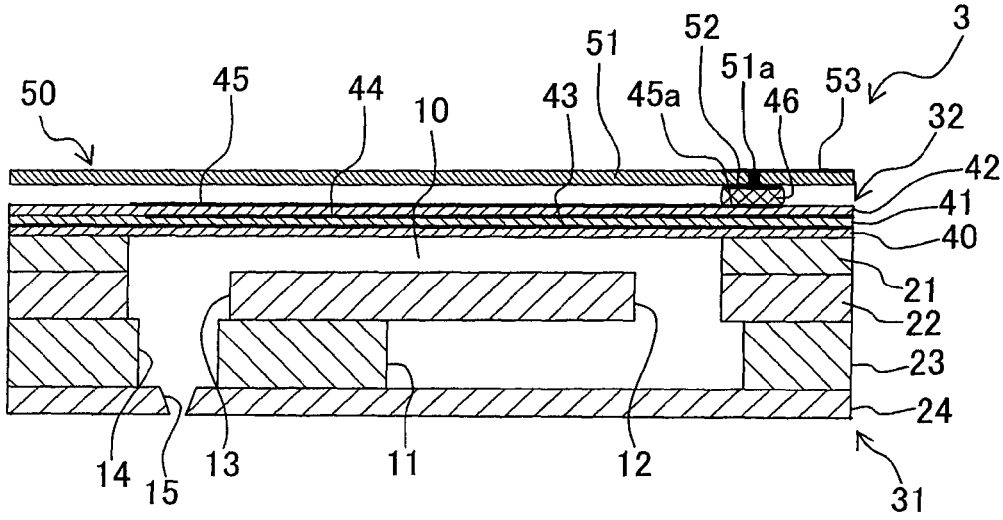
FIG. 5 is a cross-sectional view taken along a line V-V in FIG. 4A.
Figure 6:
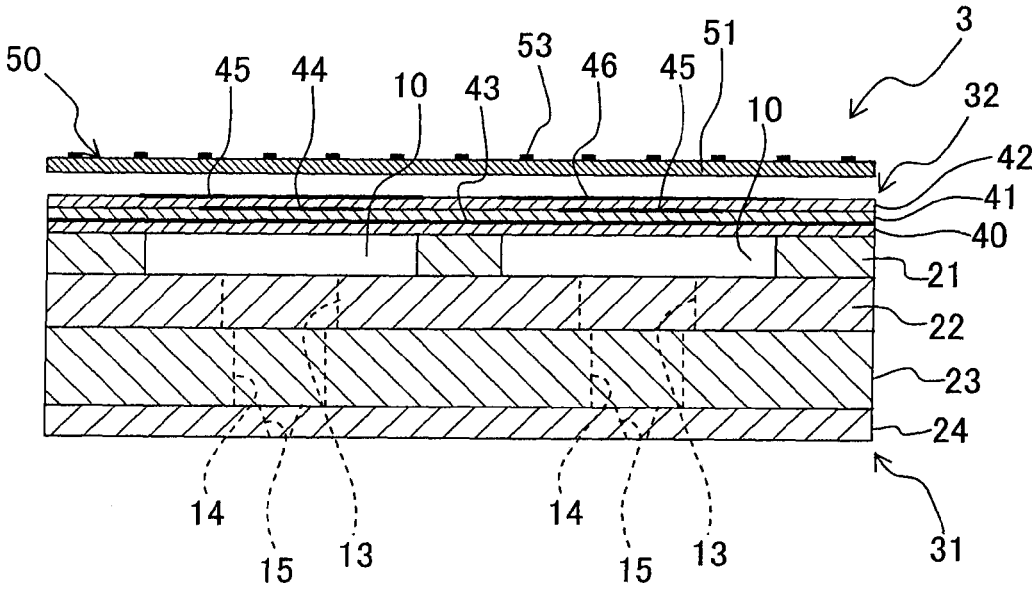
FIG. 6 is a cross-sectional view taken along a line VI-VI in FIG. 4A.

The carriage 2 reciprocates in a left-right direction (scanning direction) in FIG. 1. The ink jet head 3 is arranged on a lower surface of the carriage 2, and jets an ink from nozzles 15 formed in a lower surface thereof (refer to FIG. 5). The paper transporting roller 4 transports a recording paper P in a frontward direction (paper feeding direction) in FIG. 1.

Moreover, in the ink-jet printer 1, printing is carried out on the recording paper P transported in the paper feeding direction by the paper transporting roller 4, by an ink from the ink jet head 3 reciprocating in the scanning direction together with the carriage 2, being jetted on the recording paper P.

Next, the ink-jet head 3 will be described below by referring to diagrams from FIG. 2 to FIG. 6. To make the diagrams easily understandable, in FIG. 3, and FIG. 4A to FIG. 4D, a part of ink channels of a channel unit 31 which will be described later is omitted, and in FIG. 3, a lower electrode 43 and an intermediate electrode 44 of a piezoelectric actuator 32 are omitted. Moreover, in FIG. 4A, the lower electrode 43 and the intermediate electrode 44 are indicated by an alternate long and two short dashes line and an alternate long and short dash line respectively. Furthermore, in diagrams from FIG. 4B to FIG. 4D, the lower electrode 43, the intermediate electrode 44, and an upper electrode 45 which will be described later are hatched.

As shown in diagrams from FIG. 2 to FIG. 6, the ink-jet head 3 includes the channel unit 31 and a piezoelectric actuator 32. In the channel unit 31, ink channels (liquid transporting channels) having a plurality of individual ink channels from an ink supply port 9 up to a manifold channel 11 to which the ink is supplied, from an outlet of the manifold channel 11 up to a pressure chamber 10 via a channel 12, and further from the pressure chamber 10 up to the nozzles 15 via channels 13 and 14, are formed by a plurality of plates 21, 22, 23, and 24 (hereinafter, 'plates 21 to 24') being stacked mutually. As it will be described later, a pressure is applied to the ink inside the pressure chamber 10 by the piezoelectric actuator 32, and the ink is discharged from the nozzle 15 communicating with the pressure chamber 10.

Each pressure chamber 10 has a substantially elliptical shape in a plan view with the scanning direction (left-right direction in FIG. 3) as a longitudinal direction of the elliptical shape, and by the plurality of pressure chambers 10 arranged in a row along the paper feeding direction (vertical direction in FIG. 3), one pressure chamber row 8 is formed. By two pressure chamber rows 8 being arranged in the scanning direction, one pressure chamber group 7 is formed. Furthermore, five pressure chamber groups 7 are arranged along the scanning direction. Here, the pressure chambers 10 forming the two pressure chamber rows 8 included in one pressure chamber group 7 are arranged to be shifted mutually with respect to the paper feeding direction. Moreover, the plurality of nozzles 15 is arranged similarly as the plurality of pressure chambers 10.

Figure 3:
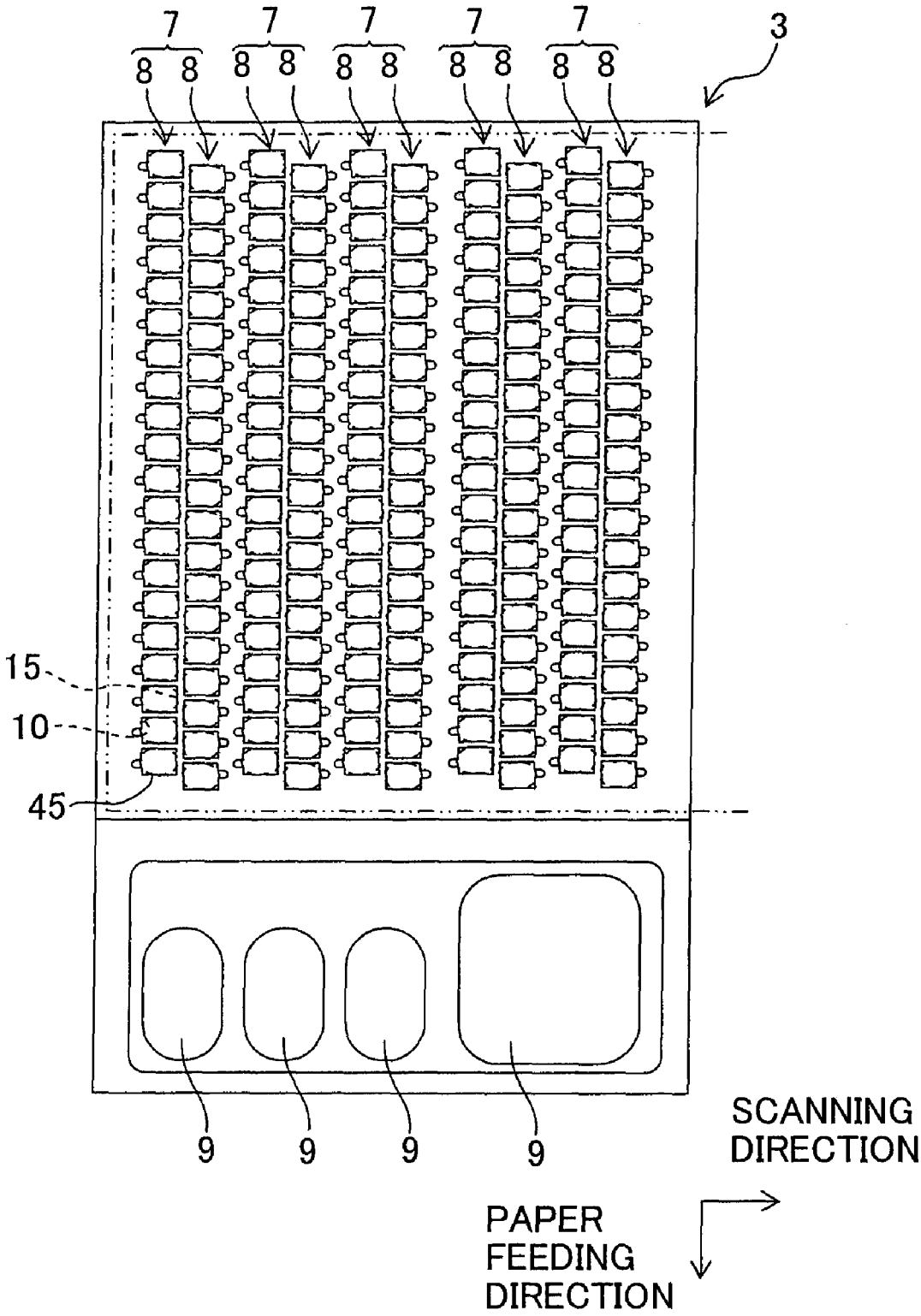
FIG. 3 is a plan view of FIG. 2.

A black ink is jetted from nozzles 15 corresponding to the pressure chambers 10 forming two pressure chamber groups on a right side in FIG. 3, from among the five pressure chamber groups 7. Moreover, inks of yellow, cyan, and magenta colors are jetted from the nozzles 15 corresponding to the pressure chambers 10 forming the pressure chamber groups 7 on a left side in FIG. 3, in order from the nozzles 15 on the right side in FIG. 3. Since a structure of the other portion of the ink channels is similar as a conventional structure, the detail description thereof is omitted here.

The piezoelectric actuator 32 includes a vibration plate 40, piezoelectric layers 41 and 42, the lower electrode 43, the intermediate electrode 44, and the upper electrode 45. The vibration plate 40 is made of a piezoelectric material which is principally composed of lead zirconate titanate which is a mixed crystalline material composed of lead titanate and lead zirconate, and is arranged on an upper surface of the channel unit 31 to cover the plurality of pressure chambers 10. A thickness of the vibration plate 40 is approximately 20 μm. The vibration plate 40 is not necessarily required to be made of a piezoelectric material.

The piezoelectric layers 41 and 42 are made of a piezoelectric material similarly as the vibration plate 40, and are arranged on an upper surface of the vibration plate 40 upon being stacked mutually. Moreover, a thickness of each of the piezoelectric layers 41 and 42 is approximately 20 μm.

The lower electrode 43 is arranged between the vibration plate 40 and the piezoelectric layer 41, and is extended in the paper feeding direction along the two pressure chamber rows 8 forming each pressure chamber group 7, corresponding to each pressure chamber group 7. The lower electrode 43 is facing the plurality of pressure chambers 10 which form these two pressure chamber rows 8. Although it is not shown in the diagram, portions of the lower electrodes 43 extended in the paper feeding direction are connected mutually. Moreover, the lower electrode 43 is connected to a driver IC 54 which is mounted on a COF (chip on film) 50 arranged at an upper side of the piezoelectric actuator 32, and is kept all the time at a ground electric potential by the driver IC 54.

Figures 4A, 4B, 4C, 4D:
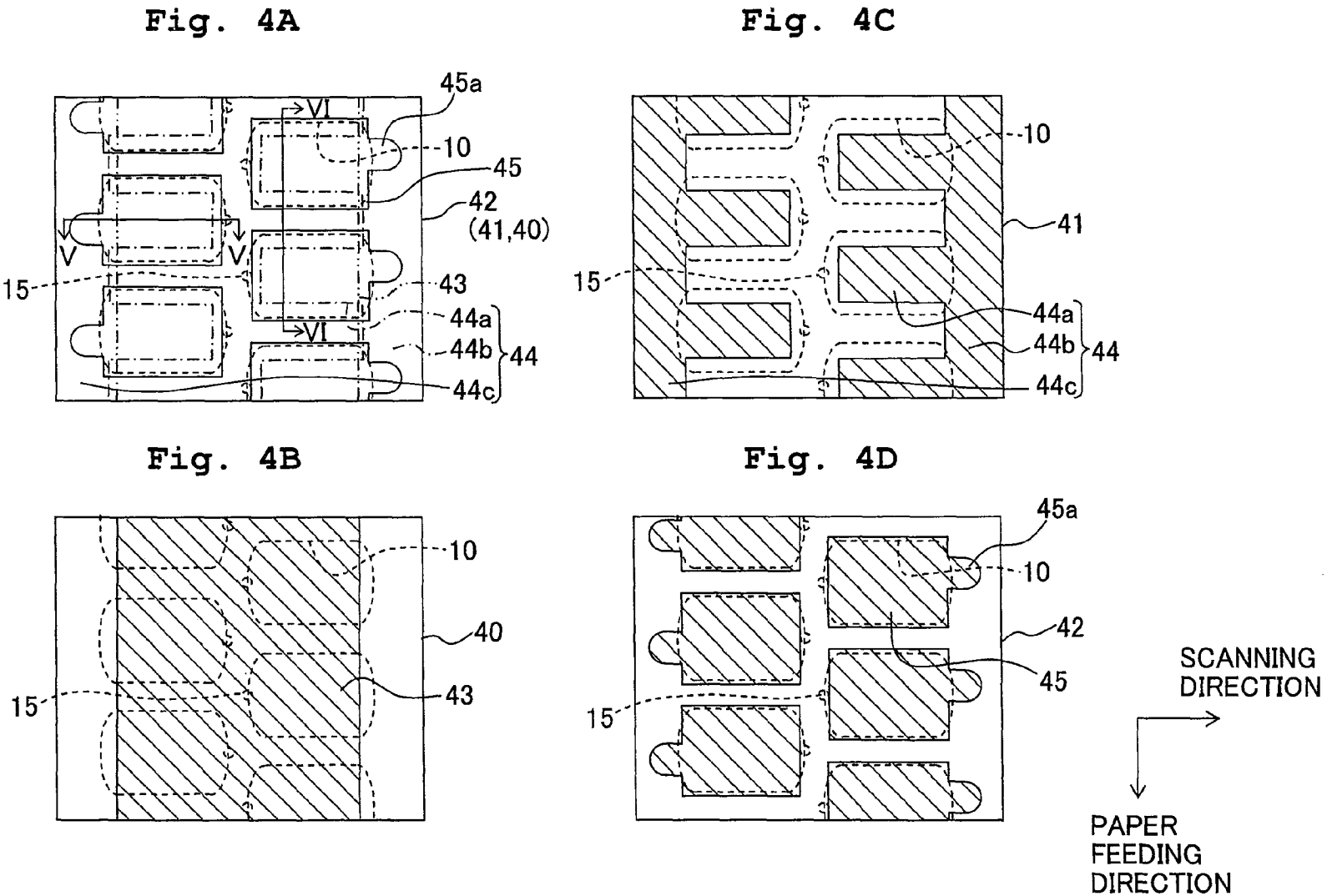
FIG. 4A is a partially enlarged view of FIG. 3, and FIG. 4B, FIG. 4C, and FIG. 4D (hereinafter, 'FIG. 4B to FIG. 4D') are diagrams of a surface of a vibration plate and piezoelectric layers in FIG. 4A.

The intermediate electrode 44 is arranged between the piezoelectric layer 41 and the piezoelectric layer 42, and as shown in FIG. 4C, the intermediate electrode 44 has a plurality of facing portions 44*a* and connecting portions 44*b* and 44C for each pressure chamber group 7. The plurality of facing portions 44*a* have a substantially rectangular plane shape with a length in the paper feeding direction shorter than the pressure chamber 10, and are arranged to be facing a central portion in the paper feeding direction of the plurality of pressure chambers 10.

The connecting portion 44*b* is extended in the paper feeding direction, and connects a right end of the plurality of facing portions 44*a* corresponding to the plurality of pressure chambers 10 arranged at a right side in FIG. 4C. The connecting portion 44*c* is extended in the paper feeding direction, and connects a left end of the plurality of facing portions 44*a* corresponding to the plurality of pressure chambers 10 arranged at a left side in FIG. 4C. Moreover, the intermediate electrode 44 is connected to the driver IC 54 mounted on the COF 50, and is kept at a predetermined electric potential (such as about 20 V) by the driver IC 54.

The plurality of upper electrodes 45 is arranged on an upper surface of the piezoelectric layer 42, facing almost entire area of the plurality of pressure chambers 10, corresponding to the plurality of pressure chambers 10. Each upper electrode 45 has a substantially rectangular plane shape with a length in the paper feeding direction longer than the facing portion 44*a* of the intermediate electrode 44. Moreover, a portion of the upper electrode 45, at an end on an opposite side of the nozzle 15 in the scanning direction is extended up to a portion not facing the pressure chamber 10 in the scanning direction, and this portion is a connecting terminal 45*a* to be connected to the COF 50. The upper electrode 45 is connected to the driver IC 54 mounted on the COF 50, and an electric potential thereof is switched between the ground electric potential and the predetermined electric potential (such as 20 V).

A portion of the abovementioned piezoelectric layer 42 sandwiched between the upper electrode 45 and the intermediate electrode 44 is polarized upwardly. Moreover, a portion of the piezoelectric layers 41 and 42 sandwiched between the upper electrode 45 and the lower electrode 43 is polarized downward (is polarized in a downward direction) from the upper electrode 45 toward the lower electrode 43. Furthermore, a portion of the piezoelectric layer 41 sandwiched between the intermediate electrode 44 and the lower electrode 43 is polarized downwardly from the intermediate electrode 44 toward the lower electrode 43.

An operation of the piezoelectric actuator 32 will be described below. Firstly, at a stand-by state before the piezoelectric actuator 32 carries out an operation of jetting the ink, as it has been described above, the lower electrode 43 and the intermediate electrode 44 are kept at the ground electric potential all the time and the predetermined electric potential (such as 20 V) respectively, and an electric potential of the upper electrode 45 is kept at the ground electric potential in advance. In this state, the upper electrode 45 is at the electric potential lower than the electric potential of the intermediate electrode 44, and is at the same electric potential as the lower electrode 43.

Accordingly, an electric potential difference is developed between the upper electrode 45 and the intermediate electrode 44, and an electric field in an upward direction same as the direction of polarization thereof is generated in a portion of the piezoelectric layer 42 sandwiched between the upper electrode 45 and the intermediate electrode 44. Moreover, the portion of the piezoelectric layer 42 sandwiched between the upper electrode 45 and the intermediate electrode 44 contracts in a horizontal direction orthogonal to the electric field in the upward direction. Accordingly, a so-called unimorph deformation occurs, and a portion as a whole of the piezoelectric layers 41 and 42, and the vibration plate 40 facing the pressure chambers 10 is deformed to form a projection toward the pressure chamber 10. In this state, a volume of the pressure chamber 10 becomes smaller as compared to a volume in a case in which the piezoelectric layers 41 and 42, and the vibration plate 40 are not deformed.

At the time of driving the piezoelectric actuator 32 to jet the ink, the electric potential of the upper electrode 45, after switching once to the predetermined electric potential, is returned to the ground electric potential. When the electric potential of the upper electrode 45 is switched to the predetermined electric potential, the electric potential of the upper electrode 45 becomes same as the electric potential of the intermediate electrode 44, and becomes higher than the electric potential of the lower electrode 43. Accordingly, the contraction of the piezoelectric layer 42 returns to an original state. At the same time, an electric potential difference is developed between the upper electrode 45 and the lower electrode 43, and an electric field in a downward direction which is same as the direction of polarization is developed in a portion of the piezoelectric layers 41 and 42 sandwiched between the upper electrode 45 and the lower electrode 43. The portion of the piezoelectric layers 41 and 42 sandwiched between the upper electrode 45 and the lower electrode 43 contracts in the horizontal direction. Accordingly, the piezoelectric layers 41 and 42, and the vibration plate 40 as a whole, are deformed to form a projection toward the opposite side of the pressure chamber 10, and the volume of the pressure chamber 10 increases. As a result, a pressure on the ink inside the pressure chamber 10 is decreased, and the ink flows from the manifold channel 11 to the pressure chamber 10.

Thereafter, when the electric potential of the upper electrode 45 is returned to the ground electric potential, as it has been described above, the portion as a whole of the piezoelectric layers 41 and 42, and the vibration plate 40 facing the pressure chamber 10 is deformed to form a projection toward the pressure chamber 10, and the volume of the pressure chamber 10 decreases. Accordingly, the pressure of the ink inside the pressure chamber 10 rises up, and the ink is jetted from the nozzle 15 communicating with the pressure chamber 10.

When the electric potential of the upper electrode 45 is switched from the ground electric potential to the predetermined electric potential, a portion of the piezoelectric layer 42 between the upper electrode 45 and the intermediate electrode 44 elongates from a state of being contracted to a state before contraction, and the portion of the piezoelectric layers 41 and 42 sandwiched between the upper electrode 45 and the lower electrode 43 contracts. Therefore, the elongation of the piezoelectric layer 42 is partly absorbed in the contraction of the piezoelectric layers 41 and 42.

Whereas, when the electric potential of the upper electrode 45 is returned from the predetermined electric potential to the ground electric potential, the portion of the piezoelectric layer 42 sandwiched between the upper electrode 43 and the intermediate electrode 44 contracts, and the portion of the piezoelectric layers 41 and 42 sandwiched between the upper electrode 45 and the lower electrode 43 elongates up to the state before contraction. Therefore, the contraction of the piezoelectric layer 42 is partly absorbed by the elongation of the piezoelectric layers 41 and 42.

Accordingly, a so-called cross talk in which the deformation of the portion of the piezoelectric layers 41 and 42 facing the pressure chamber 10 is transmitted to the portion facing the other pressure chambers 10, and jetting characteristics of ink from the nozzles 15 communicating with the other pressure chambers 10 fluctuate, is suppressed.

In the abovementioned stand-by state and while the piezoelectric actuator 32 is being driven, an electric potential is developed all the time in a portion of the piezoelectric layer 41 between the intermediate electrode 44 and the lower electrode 43. Therefore, an electric field in a direction same as the direction of polarization is generated in the portion of the piezoelectric layer 41 between the intermediate electrode 44 and the lower electrode 43. Accordingly, the portion of the piezoelectric layer 41 between the intermediate electrode 44 and the lower electrode 43 is always in a contracted state all the time.

Moreover, the ink-jet head 3, at the time of driving the piezoelectric actuator 32 as described above, is capable of jetting selectively, a plurality of types of inks (is capable of jetting inks in a plurality of jetting modes) of mutually different volume from the nozzle 15, by changing the time since the upper electrode 45 is let to be at the ground electric potential till returning to the predetermined electric potential.

Next, the COF 50 for applying an electric potential to the lower electrode 43, the intermediate electrode 44, and the upper electrode 45 of the piezoelectric actuator 32 will be described below. The COF 50 has a substrate 51, a land 52, a wire 53, the driver IC 54, and a connecting terminal 55. The substrate 51 is made of a synthetic resin material such as polyimide. One end portion of the substrate 51 is facing the piezoelectric layer 42 and is drawn toward an outer side from the portion facing the piezoelectric layer 42.

The land 52 is formed on a portion of a lower surface of the substrate 51, facing the connecting terminal 45*a*, and the connecting terminal 45*a* and the land 52 are connected via a solder 46. The driver IC 54 is arranged on an upper surface of the substrate 51. The connecting terminal 55 is formed on an end at an opposite side of the portion of the substrate 51, facing the piezoelectric actuator 32, and is connected to a control unit 59 (refer to FIG. 7).

Moreover, the land 52 and the driver IC 54, and the driver IC 54 and the connecting terminal 55 are connected via a wire 53 formed on the upper surface of the substrate 51. The wire 53 formed on the upper surface of the substrate 51 and the land 52 formed on the lower surface of the substrate 51 are connected via a through hole 51*a* formed in the substrate 51.

Next, an electrical structure of the driver IC 54 and the control unit 59 will be described below by referring to FIG. 7.

Figure 7:
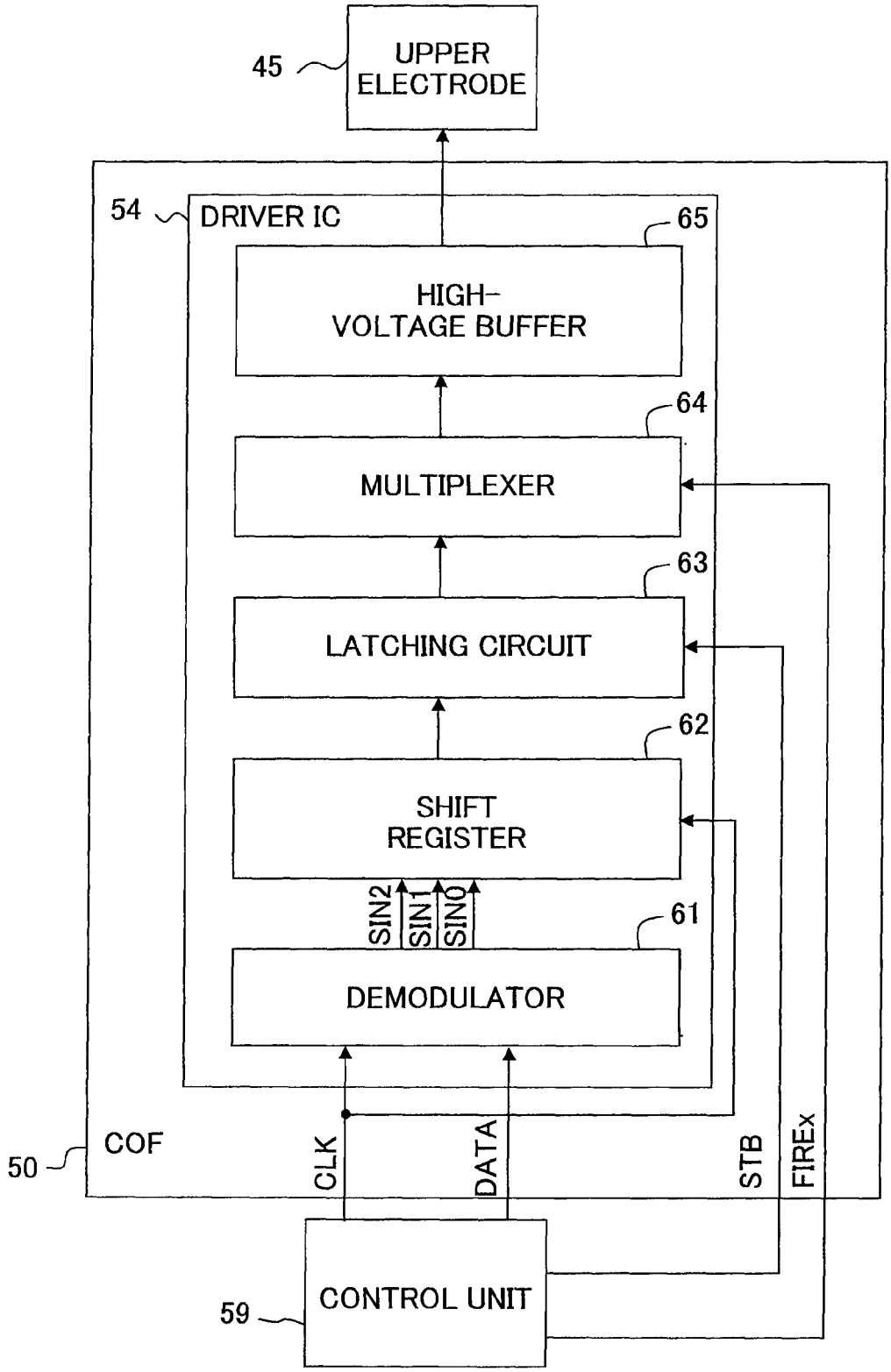
FIG. 7 is a block diagram showing an electrical structure (arrangement) of a driver IC and a control unit.

As shown in FIG. 7, the driver IC 54 has a demodulator 61 (a demodulator for recording head), a shift register 62, a latching circuit 63, a multiplexer 64, and a high-voltage buffer circuit 65.

A modulating jetting signal DATA and a reference clock CLK which will be described later are inputted serially in time series to the modulator 61. The modulating jetting signal DATA is generated by ink jetting signals SIN 0, SIN 1, and SIN 2 (a value of each of SIN 0, SIN 1, and SIN 2 is 1 or 0) of three bits corresponding to a jetting volume of the ink (a jetting mode of the ink) in each channel of the ink-jet head 3 being modulated in a modulator 60 which will be described later, of the control unit 59. Moreover, the demodulator 61 demodulates the modulating jetting signal which is inputted, to the ink jetting signals SIN 0, SIN 1, and SIN 2, and outputs to the shift register 62.

The shift register 62 retains in order, the ink jetting signals SIN 0, SIN 1, and SIN 2 of each channel, inputted serially in time series from the modulator 61, and outputs to the latching circuit 73 upon converting to parallel signals in which the ink jetting signals SIN 0, SIN 1, and SIN 2 corresponding to all channels are lined in parallel. A strobe STB which is outputted after the modulating jetting signals DATA corresponding to all channels are transferred from the control unit 59 to the driver IC 54, is inputted to the latching circuit 73. When the strobe STB has been inputted, the latching circuit 73 outputs the parallel signals which are inputted from the shift register 62, to the multiplexer 64.

Driving waveforms FIRE x (x=0, 1, . . . , 6, 7) corresponding to the jetting volume of ink from the nozzle 15 are inputted in order from the control unit 59 to the multiplexer 74. When the FIRE x have been inputted, the multiplexer 74, with respect to the channels for which the values of the ink jetting signals SIN 0, SIN 1, and SIN 2 correspond to that FIRE x, amplifies the driving waveforms FIRE x which have been inputted, in the high-voltage buffer 75, and outputs to the upper electrode 45. Accordingly, the electric potential of the upper electrode 45 changes as described above, and the piezoelectric actuator 32 is driven.

Figure 8:
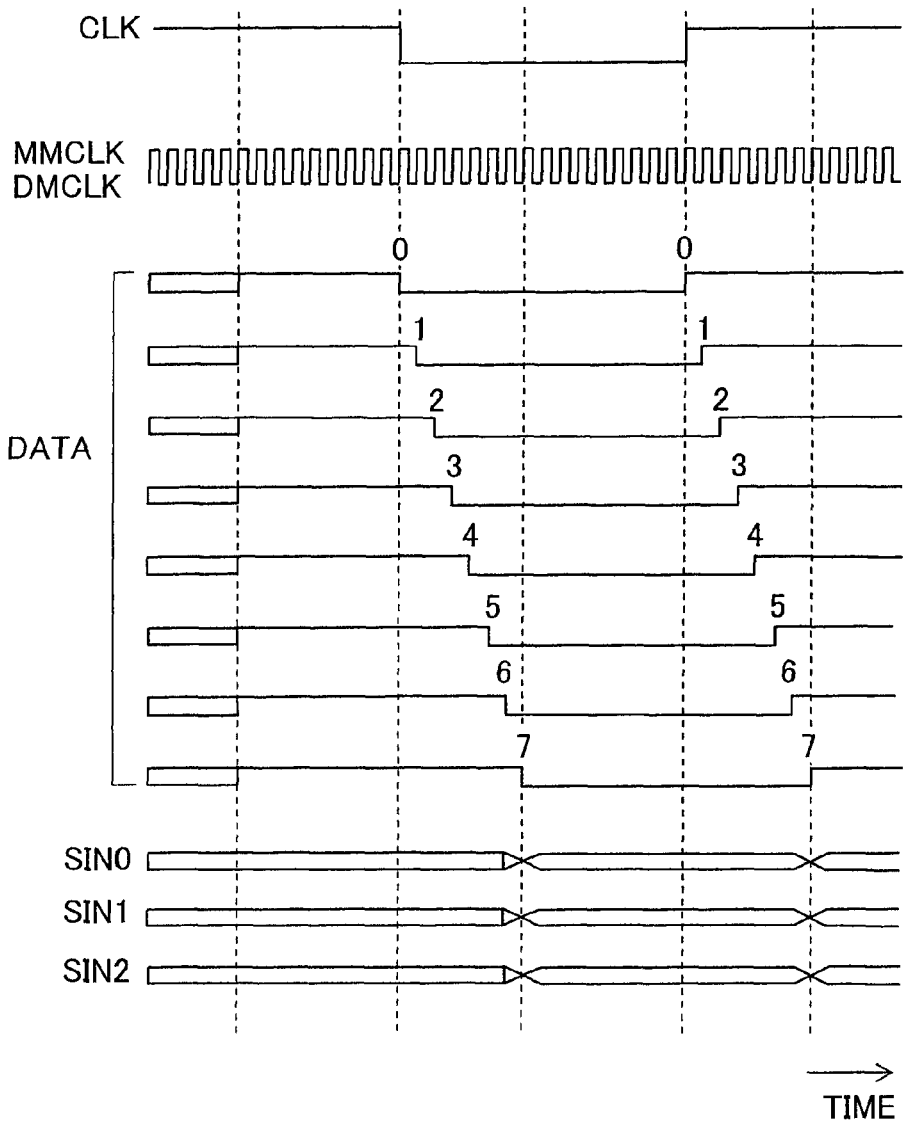
FIG. 8 is a diagram showing a time change of each clock and a signal in the driver IC and the control unit.

Next, the control unit 59 and the demodulator 61 will be described below in detail by referring to FIG. 8, FIG. 9, and FIG. 10.

Figure 9:
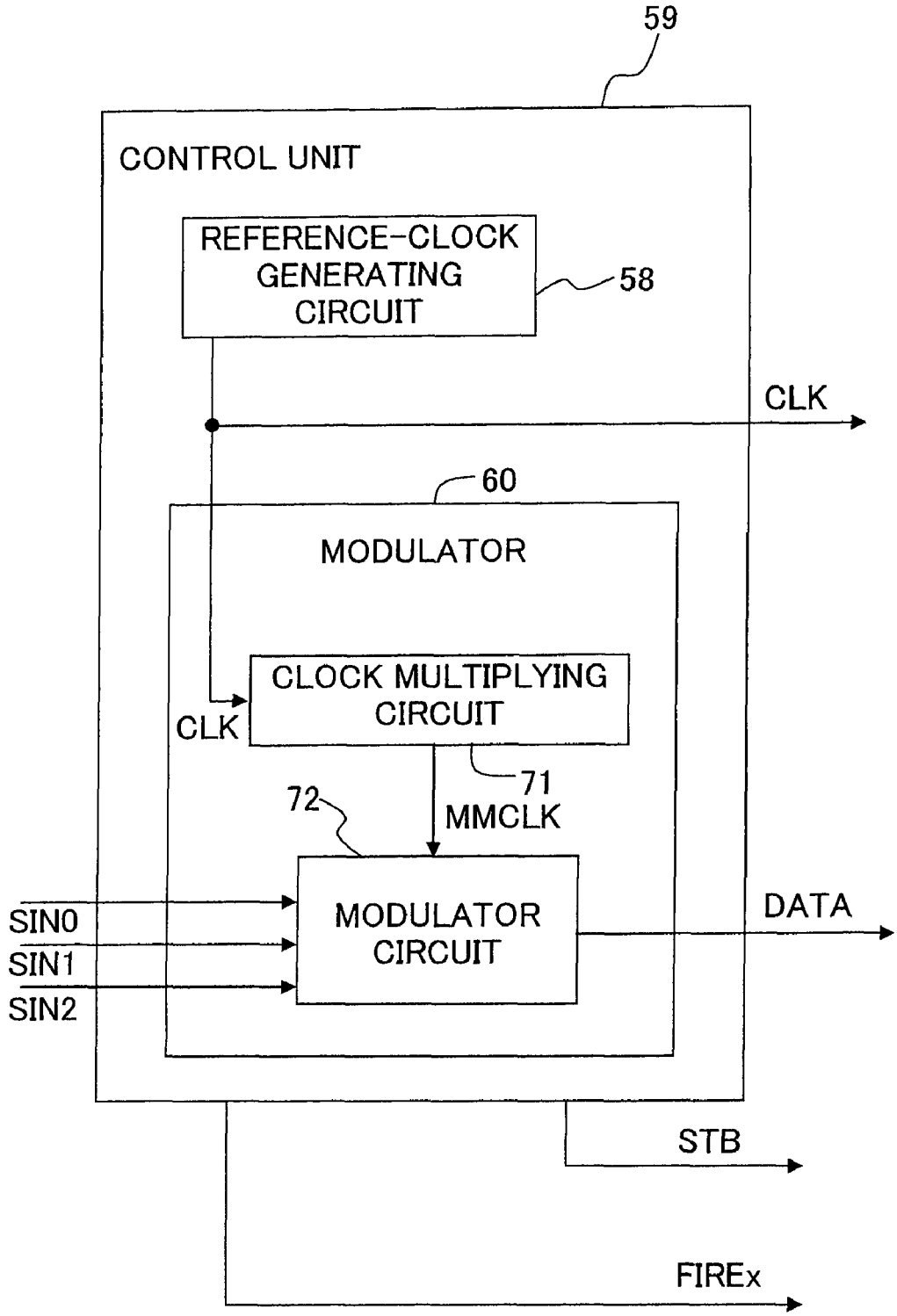
FIG. 9 is a block diagram showing a structure of the control unit in FIG. 7.

The control unit 59, as shown in FIG. 9, has a reference-clock generating circuit 58 and the modulator 60. The reference-clock generating circuit 58 is a circuit which generates the reference clock CLK of a predetermined constant cycle. The reference clock CLK of the constant cycle generated in the reference-clock generating circuit 58 is outputted to the modulator 60 and the demodulator 61. When the reference clock CLK is transferred to the demodulator 61 via a circuit board for example, for reducing a noise radiated from each wire of the circuit board, it is desirable that a frequency of the reference clock CLK is 10 MHz or less. The modulator 60 has a clock multiplying circuit 71 and a modulator circuit 72. The clock multiplying circuit 71 generates a multiplying clock for modulation MMCLK (modulation clock) by multiplying (16 times for example) the reference clock CLK which has been inputted from outside, and outputs to the modulator circuit 72.

The modulation multiplying clock MMCLK is inputted to the modulator circuit 72, and also, the ink jetting signals SIN 0, SIN 1, and SIN 2 are inputted to the modulator circuit 72. Moreover, the modulator circuit 72 generates a modulating jetting signal DATA of which, a value changes at a timing at which a value of the modulation multiplying clock MMCLK is changed for a predetermined number of times corresponding to a value of the ink jetting signals SIN 0, SIN 1, and SIN 2 after a value of the reference clock CLK is changed, and outputs to the demodulator 61.

Here, as the time after the value of the reference clock CLK has changed becomes longer, the number of times for which the value of the modulation multiplying clock MMCLK generated by multiplying the reference clock CLK changes, becomes large. Therefore, the number of times for which the value of the modulation multiplying clock MMCLK changes during the time since the value of reference clock CLK has changed until the value of the modulating jetting signal DATA changes, corresponds to the time after the value of the reference clock CLK has changed.

Consequently, the value of the modulating jetting signal DATA which is outputted from the modulator circuit 72 changes at the timing, based on the reference clock CLK, corresponding to the value of the ink jetting signals SIN 0, SIN 1, and SIN 2.

Accordingly, the ink jetting signals SIN 0, SIN 1, and SIN 2 of three bits are synchronized with the reference clock CLK, and the timing, based on the reference clock CLK, at which the value changes is modulated to the modulating jetting signal DATA corresponding to the value of the ink jetting signals SIN 0, SIN 1, and SIN 2. Concretely, as shown in FIG. 8, when the timing at which the value of the reference clock CLK changes is let to be the reference, one of eight types of signals for which the timing at which a value changes differ mutually, is outputted selectively according to the value of the ink jetting signals SIN 0, SIN 1, SIN 2 from the modulator circuit 72, as the modulating jetting signal DATA.

Moreover, apart from the modulator 60, circuits such as a circuit for generating and outputting the strobe STB and the driving waveforms FIRE x are also included in the control unit 59. However, these circuits and the description in detail thereof are omitted here.

Figure 10:
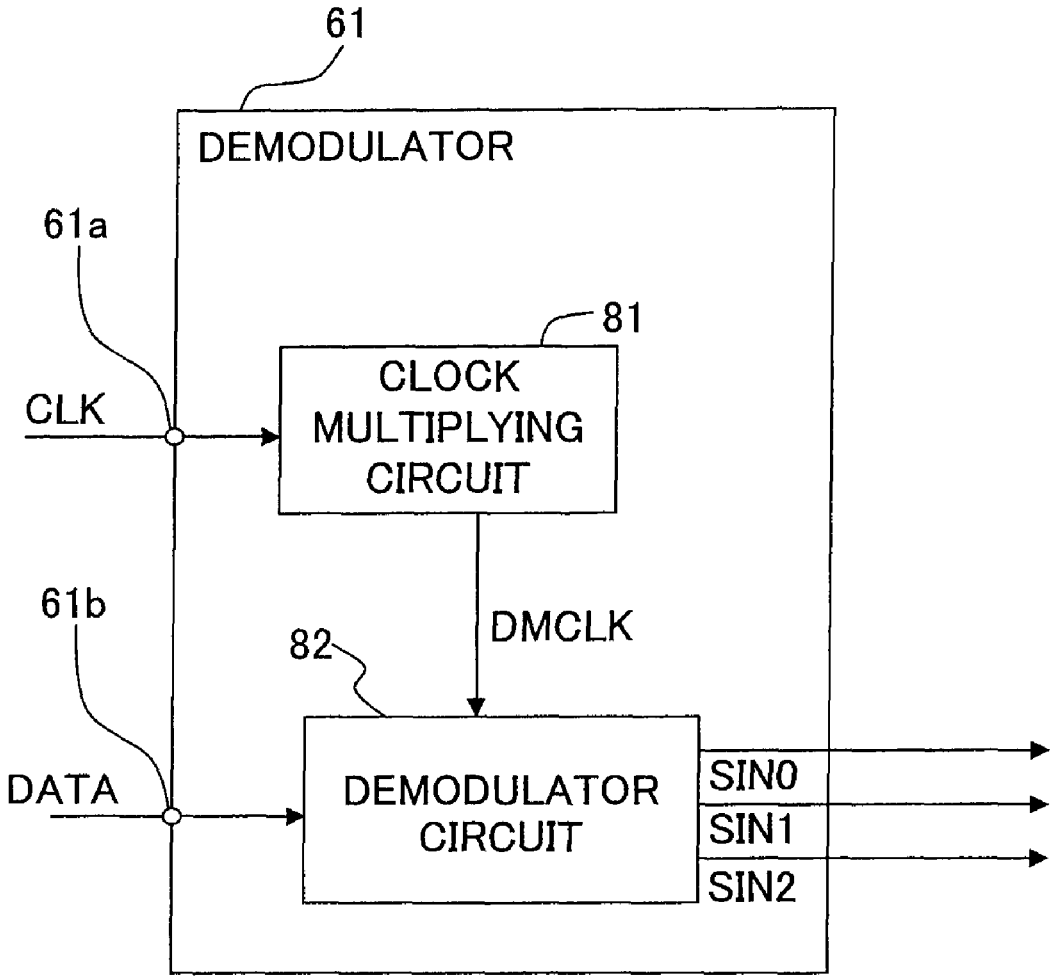
FIG. 10 is a block diagram showing a structure of a modulator in FIG. 7.

The demodulator 61, as shown in FIG. 10, has a clock multiplying circuit 81 (a demodulation-clock generating circuit) and a demodulator circuit 82. The clock multiplying circuit 81 is a circuit having a structure similar to the clock multiplying circuit 71. The clock multiplying circuit 81 generates a multiplying clock for demodulation DMCLK (demodulation clock) similarly as the modulation multiplying clock MMCLK by multiplying the reference clock which has been inputted from an input terminal 61 (reference-clock input section), and outputs to the demodulator circuit 82.

The demodulation multiplying clock DMCLK is inputted to the demodulator circuit 82, and also, the modulating jetting signal DATA is inputted to the demodulator circuit 82 from an input terminal 61*b* (demodulated-signal input section). Moreover, the demodulator circuit 82 detects the number of times for which a value of the demodulation multiplying clock DMCLK has changed during the time since the value of the reference clock CLK changed till the value of the modulating jetting signal DATA changes, and outputs the ink jetting signals SIN 0, SIN 1, and SIN 2 corresponding to the number of times for which the value of the demodulation multiplying clock DMCLK has changed, to the shift register 62 (demodulates the modulating jetting signal DATA to the ink jetting signals SIN 0, SIN 1, and SIN 2).

As the time since the value of the reference clock CLK has changed till the value of the modulating jetting signal DATA changes becomes long, the number of times for which the value of the demodulation multiplying clock DMCLK changes during this time becomes large. Therefore, the number of times for which the value of the demodulation multiplying clock DMCLK changes during the time since the value of the reference clock CLK has changed till the value of the modulating jetting signal DATA changes, corresponds to the time since the value of the reference clock CLK has changed till the demodulating jetting signal changes.

Consequently, the number of times for which the value of the demodulation multiplying clock DMCLK has changed during the time since the value of the reference clock CLK has changed till the value of the modulating jetting signal DATA changes, corresponds to the time since the value of the reference clock CLK has changed till the value of the modulating jetting signal DATA changes (the timing, based on the reference clock CLK, at which the value of the modulating jetting signal DATA changes). Accordingly, the ink jetting signals SIN 0, SIN 1, and SIN 2 outputted from the demodulator circuit 82 correspond to the modulating jetting signal DATA.

In this manner, in the first embodiment, it is possible to transfer the modulating jetting signal data DATA corresponding to the ink jetting signals SIN 0, SIN 1, and SIN 2 of three bits, to the driver IC 54 from the control unit 59, every time whenever the value of the reference clock CLK changes. Therefore, as conventionally, as compared to a case of just transferring the jetting signal as it is, every time whenever the value of the reference clock CLK changes, it is possible to transfer a large number of signals from the control unit 59 to the driver IC 54 without increasing the frequency of the reference clock CLK, or increasing the number of signal wires. In the first embodiment, a unit in which the modulator 60 and the demodulator 61 are combined corresponds to a data transfer unit of the present invention.

According to the first embodiment described above, in the modulator 60, the modulation multiplying clock MMCLK is generated by multiplying the reference signal CLK in the clock multiplying circuit 71. Moreover, in the modulator circuit 72, the modulating jetting signal DATA of which, the value changes at the timing at which the value of the modulation multiplying clock MMCLK has changed for the predetermined number of times corresponding to the value of the ink jetting signals SIN 0, SIN 1, and SIN 2 after the value of the reference clock CLK has changed, is generated, and is outputted to the demodulator 61 (the driver IC 54). In other words, modulator 60 modulates the ink jetting signals SIN 0, SIN 1, and SIN 2 to the modulating jetting signal DATA.

Whereas, in the demodulator 61, the demodulation multiplying clock DMCLK is generated by multiplying the reference clock CLK in the clock multiplying circuit 81. Moreover, in the demodulator circuit 82, the ink jetting signals SIN 0, SIN 1, and SIN 2 corresponding to the number of times for which the value of the demodulation multiplying clock DMCLK has changed during the time since the value of the reference clock CLK changed, till the value of the modulating jetting signal DATA changes, are outputted. In other words, the demodulator 61 demodulates the modulating jetting signal DATA to the ink jetting signals SIN 0, SIN 1, and SIN 2.

In this manner, it is possible to transfer the modulating jetting signal DATA corresponding to the ink jetting signals SIN 0, SIN 1, and SIN 2 of three bits, every time whenever the value of the reference clock CLK changes. Therefore, as conventionally, as compared to a case of just transferring the jetting signal of one bit as it is, every time whenever the value of the reference clock CLK changes, it is possible to transfer a large number of signals from the control unit 59 to the driver IC 54 without increasing the frequency of the reference clock CLK, or increasing the number of signal wires.

Next, a second embodiment according to the present invention will be described below by referring to diagrams from FIG. 11 to FIG. 13. However, the control unit 59 in the first embodiment is replaced by a control unit 110, and the demodulator 61 of the first embodiment is replaced by a demodulator 141 (a demodulator for recording head). Therefore, only the control unit 110 and the demodulator 141 will be described below.

Figure 11:
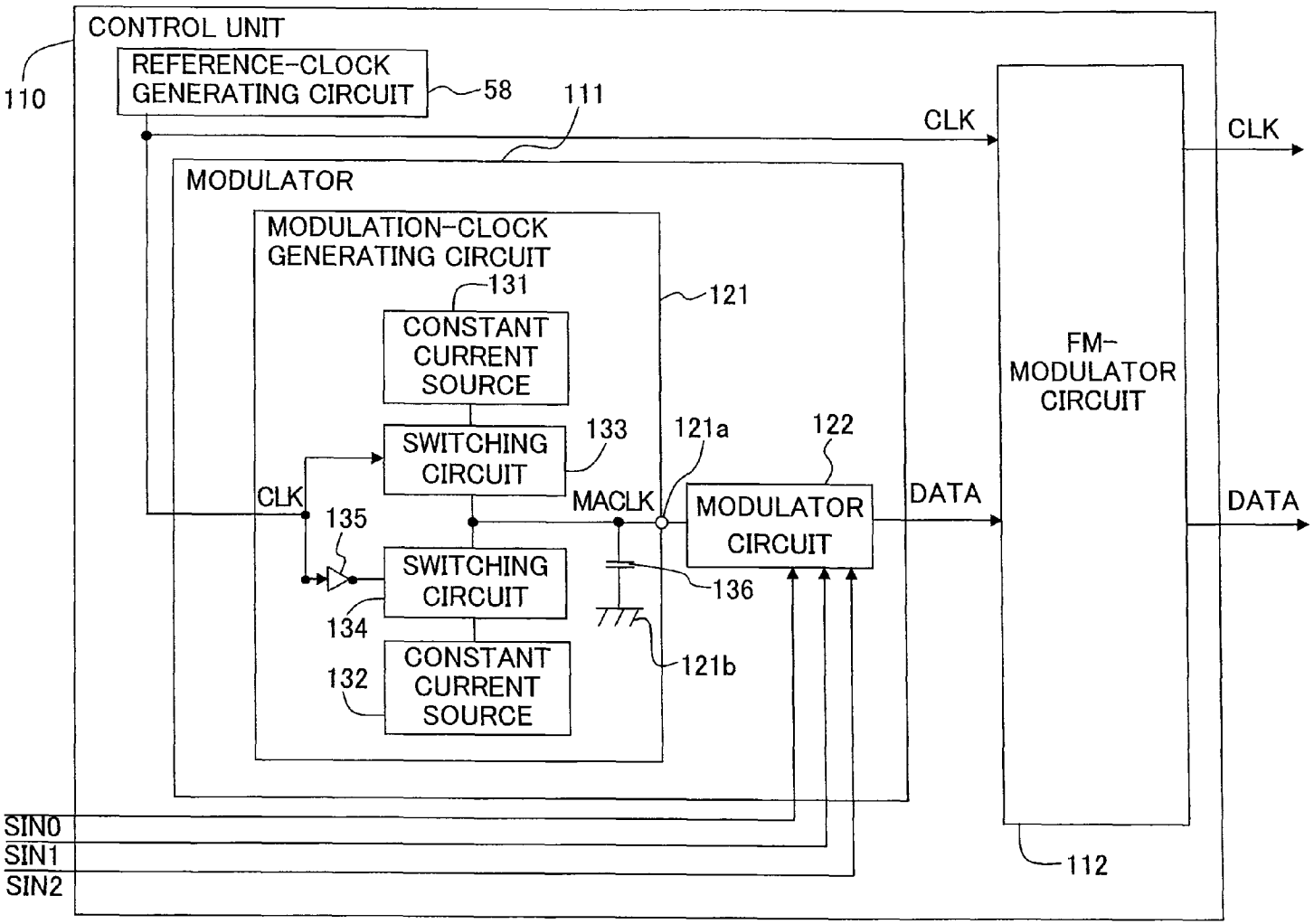
FIG. 11 is a diagram corresponding to FIG. 9, of a second embodiment.

As shown in FIG. 11, the control unit 110 includes the reference-clock generating circuit 58, a modulator 111, and an FM-modulator circuit 112. The reference-clock generating circuit 58 generates the reference clock CLK which changes at a predetermined constant cycle, similarly as in the first embodiment.

The modulator 111 includes a modulation-clock generating circuit 121 and a modulator circuit 122.

The modulation-clock generating circuit 121 has two constant current sources 131 and 132, two switching circuits 133 and 134, a NOT circuit 135, and a condenser 136. The constant current source 131 (a first constant current source) is a constant current source which is capable of supplying a predetermined constant electric current to an output terminal 121*a* of the modulation-clock generating circuit 121. The constant current source 132 (a second constant current source) is a constant current source which is capable of supplying a constant electric current of an opposite direction having a same magnitude as the constant electric current supplied by the constant current source 131, to the output terminal 121*a*.

The switching circuit 133 (a first switch) is a circuit formed by a semiconductor switch etc., which is capable of switching conduction and interrupt between the constant current source 131 and the output terminal 121*a*. The reference clock CLK is inputted to the switching circuit 133 from the control unit 59. Moreover, the switching circuit 133, when the value of the reference clock CLK which is inputted is H (High), brings the constant current source 131 and the output terminal 121*a* in conduction, and when the value of the reference clock CLK which is inputted is L (Low), interrupts the conduction between the constant current source 131 and the output terminal 121*a*.

The switching circuit 134 (the second switch), similarly as the switching circuit 133, is a circuit which is capable of switching the conduction and interrupt between the constant current source 132 and the output terminal 121*a*, and the reference clock CLK is inputted from the control unit 59 via the NOT circuit 135 which outputs upon reversing a value which is inputted. Moreover, the switching circuit 134, when the value of the reference clock CLK is L, brings the constant current source 132 and the output terminal 121*a* in conduction, and when the value of the reference clock is H, interrupts the conduction between the constant current source 132 and the output terminal 121*a*.

In this manner, by the conduction and the interrupt between the constant current sources 131 and 132, and the output terminal 121*a* being switched by the switching circuits 133 and 134, a state (first state) in which the constant current source 131 and the output terminal 121*a* are in conduction, and the conduction between the constant current source 132 and the output terminal 121*a* is interrupted, and a state (second state) in which the constant current source 132 and the output terminal 121*a* are in conduction, and the conduction between the constant current source 131 and the output terminal 121*a* is interrupted are switched alternately, every time whenever the value of the reference clock CLK changes.

The condenser 136 is connected between the output terminal 121*a* and a ground terminal 121*b*. Moreover, when the switching circuit 133 switches to the first state, a predetermined constant current flows between the constant current source 131 and the output terminal 121*a*. Accordingly, the condenser 136 is charged, and a modulation clock MACLK which is outputted from the output terminal 121*a*, as shown in FIG. 13, is monotonically increased with time, and reaches the maximum value which is determined by the maximum electric potential, which, the constant current source 131 is capable of outputting. Moreover, when there is a time until the value of the subsequent reference clock CLK changes to L after that value has reached the maximum value, the modulation clock MACLK is maintained at the maximum value till the value of the subsequent reference clock CLK switches to L (switches to the second state).

When the state changes from this state to the second state, a constant electric current in a direction opposite to the constant electric current in the first state flows between the constant current source 132 and the output terminal 121*a*. Accordingly, an electric charge which was charged in the condenser 136 is discharged, and after the electric charge is discharged completely, the condenser 136 is charged in a direction opposite to the direction in the first state, and the modulation clock MACLK which is outputted from the output terminal 121*a*, as shown in FIG. 13, is monotonically decreased with time, and reaches the minimum value which is determined by the maximum electric potential, which, the constant current source 132 is capable of outputting. Moreover, when there is a time until the value of the subsequent reference clock CLK changes to H after the value has reached the minimum value, the modulation clock MACLK is maintained at the minimum value until the value of the subsequent reference clock CLK switches to H (switches to the first state).

As it has been described above, in the modulation-clock generating circuit 121, every time whenever the value of the reference clock CLK changes, an analog waveform of which, a value is monotonically increased from the minimum value to the maximum value with time, and of which the value is maintained at the maximum value, until the value of the subsequent reference clock CLK changes after it has reached the maximum value, and an analog waveform in which a value is monotonically decreased from the maximum value to the minimum value with time, and of which the value is maintained at the minimum value, until the value of the subsequent reference clock CLK changes after it has reached the minimum value, are outputted alternately.

The modulation clock MACLK which is an analog waveform is inputted to the modulator circuit 122 from the modulation-clock generating circuit 121, and also, the ink jetting signals SIN 0, SIN 1, and SIN 2 of three bits are inputted to the modulator circuit 122. Moreover, the modulator circuit 122 generates the modulating jetting signal DATA of which, the value changes at a timing when the value of the modulation clock MACLK has become a predetermined value corresponding to the value of the ink jetting signals SIN 0, SIN 1, and SIN 2, and outputs to the demodulator 141.

Here, till the modulation clock MACLK which is inputted to the modulator circuit 122 reaches the maximum value during the time since the value of the reference clock CLK has changed from L to H, till the value of the reference clock CLK changes subsequently from H to L, as the time after the value of the reference clock CLK has changed from L to H becomes long, the value thereof increases. In other words, the value of the modulation clock MACLK is monotonically increased. Moreover, till (the modulation clock MACLK which is inputted to the modulator circuit 122) reaches the minimum value during the time since the value of the reference clock CLK has changed from H to L, till the value of the reference clock CLK changes subsequently from L to H, as the time after the value of the reference clock CLK has changed from H to L becomes long, the value thereof becomes small. In other words, the value of the modulation clock MACLK is monotonically decreased.

Consequently, when the value of the modulation clock MACLK has become a value corresponding to the time after the value of the reference clock CLK has changed, and the modulating jetting signal DATA outputted from the modulator circuit 122, when the reference clock CLK is let to be the reference, becomes a signal of which the value changes at a timing corresponding to the value of the ink jetting signals SIN 0, SIN 1, and SIN 2.

Accordingly, the ink jetting signals SIN 0, SIN 1, and SIN 2 of three bits are synchronized with the reference clock CLK, and are modulated to the plurality of types of modulating jetting signals DATA in which the timing, based on the reference clock CLK, at which the value thereof changes are different respectively. Three digit numbers '000', '001 ', . . . , '110', '111 ' mentioned in a portion of DATA in FIG. 13 denote values of the ink jetting signals SIN 0, SIN 1, and SIN 2 in order of a digit from left, and the value of the modulating jetting signal DATA changes at a timing for which the digit numbers are mentioned according to the values of the SIN 0, SIN 1, and SIN 2.

The FM-modulator circuit 112 FM-modulates the reference clock CLK generated in the reference-clock generating circuit 58, and makes fluctuate a cycle of the reference-clock CLK which is outputted from the control unit 110, within a predetermined range with a cycle of the reference clock CLK generated in the reference-clock generating circuit 58 as a center thereof.

Here, when a reference clock CLK of a constant cycle is transferred from the control unit 110 to the driver IC (demodulator 141) without FM-modulating, a discharge noise of a substantial specific frequency is developed in a wire connecting the control unit 110 and the demodulator 141. Therefore, in the second embodiment, the reference clock CLK of the constant cycle which is generated in the reference-clock generating circuit 58 is FM-modulated, and is outputted to the demodulator 141 upon making fluctuate the cycle thereof. Accordingly, the frequency of the discharge noise is distributed, and the discharge noise becomes small.

Moreover, at this time, the modulating jetting signal DATA is also FM-modulated, and accordingly, the timing at which the value of the modulating jetting signal DATA also fluctuates corresponding to the fluctuation of the cycle (period) of the reference clock CLK.

Figure 12:
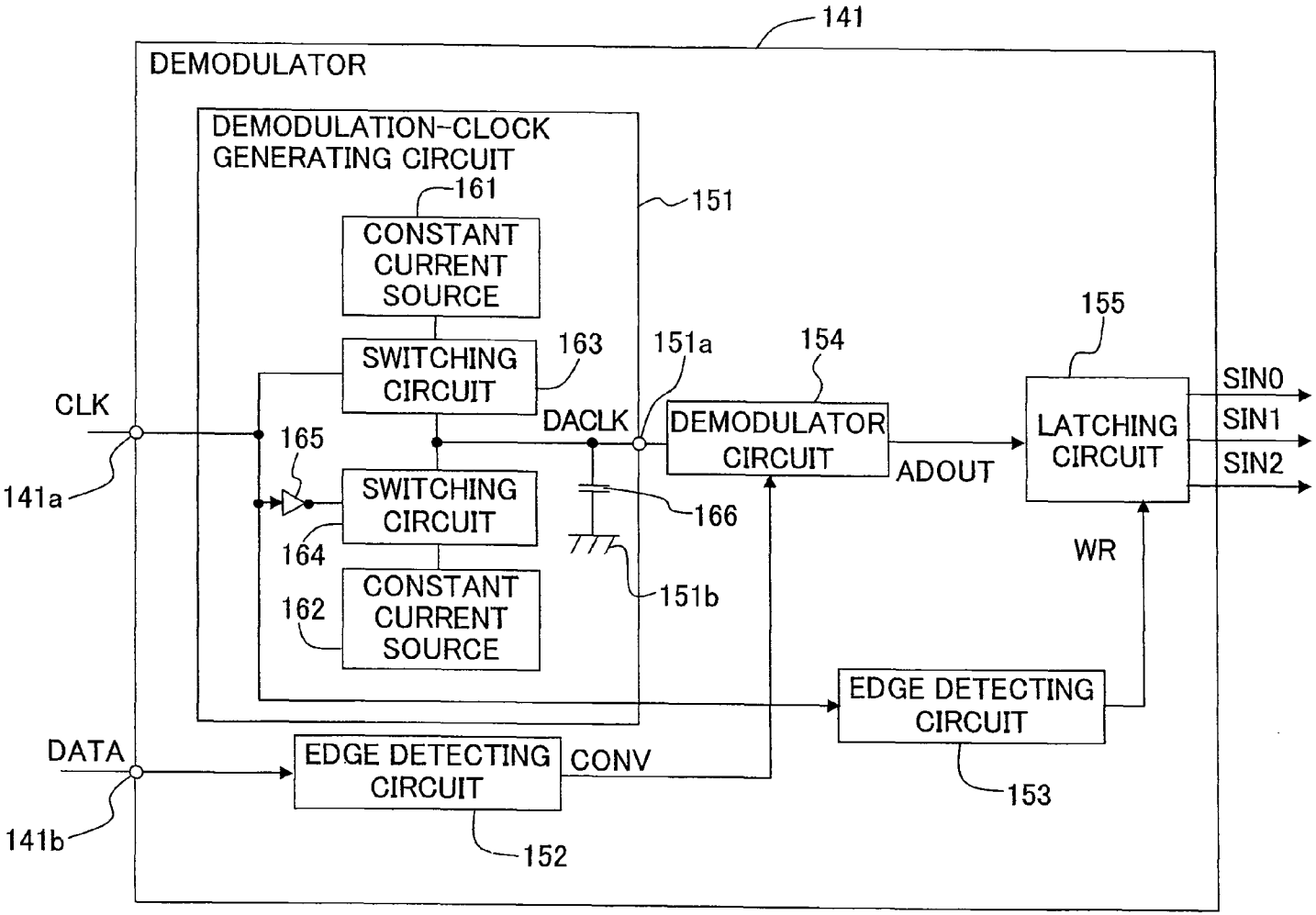
FIG. 12 is a diagram corresponding to FIG. 10, of the second embodiment.
Figure 13:
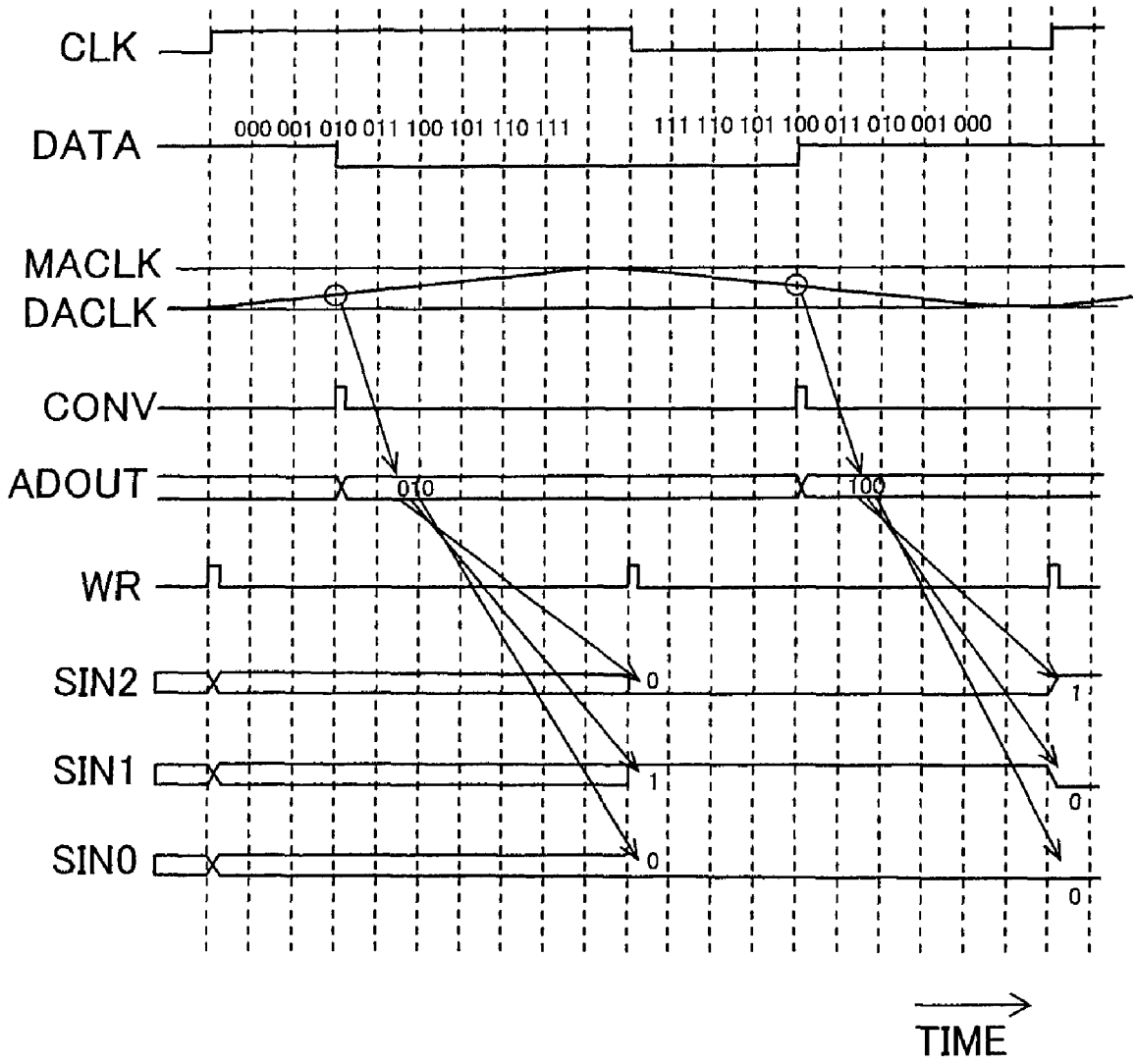
FIG. 13 is a diagram corresponding to FIG. 8, of the second embodiment.

The demodulator 141, as shown in FIG. 12, includes a demodulation-clock generating circuit 151, two edge detecting circuits 152 and 153, a demodulator circuit 154, and a latching circuit 155.

The demodulation-clock generating circuit 151, similar to the modulation-clock generating circuit 121, is a circuit which has a constant current source 161 (a first constant current source), a constant current source 162 (a second constant current source), a switching circuit 163 (a first switch), a switching circuit 164 (a second switch), a NOT circuit 165, and a condenser 166.

Moreover, the reference clock CLK is inputted to the demodulation-clock generating circuit 151 from an input terminal 141*a* (reference-clock input section), and similarly as the modulation-clock generating circuit 121, every time whenever the value of the reference clock CLK changes, the first state and the second state are switched alternately, and a constant electric current in mutually opposite direction flows between an input terminal 151*a* and a ground terminal 151*b*.

Accordingly, an analog waveform similar to the modulation clock MACLK is outputted alternately as a demodulation clock DACLK from the output terminal 151*a* of the demodulation-clock generating circuit 151 to the demodulator circuit 154. In other words, every time whenever the value of the reference clock CLK changes, an analog waveform in which a value is monotonically increased from the minimum value to the maximum value with time, and of which the value is maintained at the maximum value, until the value of the subsequent reference clock changes after it has reached the maximum value, and an analog waveform in which a value is monotonically decreased from the maximum value to the minimum value with time, and of which the value is maintained at the minimum value, until the value of the subsequent reference clock changes after it has reached the minimum value, are outputted alternately.

However, since the reference clock CLK which is inputted to the demodulation-clock generating circuit 151 is FM-modulated in the FM-modulator circuit 112, a period for which the value of the demodulation clock DACLK, fluctuates according to the cycle of the reference clock CLK which is FM-modulated as it will be described later.

Moreover, by using the constant current sources 161 and 162, the switching circuits 163 and 164, the NOT circuit 165, and the condenser 166, it is possible to form easily the demodulation-clock generating circuit 151 which outputs such demodulation clock DACLK.

The modulating jetting signal DATA is inputted to the edge detecting circuit 152 from an input terminal 141*b* (modulated-signal input section), and when it is detected that the value of the modulating jetting signal DATA has been changed, (the edge detecting circuit 152) outputs a signal CONV which indicates that the value of the modulating jetting signal DATA has changed, to the demodulator circuit 154.

The demodulator circuit 154, when the signal CONV is inputted from the edge detecting circuit 152, detects a value of the modulation clock DACLK, and outputs a signal ADOUT corresponding to the demodulation clock DACLK which is detected, to the latching circuit 155. Here, signal ADOUT is a signal corresponding to the ink jetting signals SIN 0, SIN 1, and SIN 2, and is outputted upon being converted to the ink jetting signals SIN 0, SIN 1, and SIN 2 in the latching circuit 155 as it will be described later. In other words, the demodulator circuit 154 demodulates the modulating jetting signal DATA to the ink jetting signals SIN 0, SIN 1, and SIN 2 (more appropriately, the signal ADOUT corresponding to the ink jetting signals SIN 0, SIN 1, and SIN 2).

Here, till the value of the demodulation clock DACLK which is inputted to the demodulator circuit 154 reaches the maximum value during the time since the value of the reference clock CLK has changed from L to H, till the value of the reference clock CLK changes subsequently from H to L, as the time after the value of the reference clock CLK has changed from L to H becomes long, the value thereof increases. Moreover, till (the value of the demodulation clock MACLK which is inputted to the modulator circuit 122) reaches the minimum value during the time since the value of the reference clock CLK has changed from H to L, till the value of the reference clock CLK changes subsequently from L to H, as the time after the value of the reference clock CLK has changed from H to L becomes long, the value of the demodulation clock DACLK decreases.

Consequently, the value of the demodulation clock DACLK when the signal CONV has been inputted corresponds to the time after the value of the reference clock CLK has changed, till the value of the modulating jetting signal DATA changes (a timing, based on the reference clock CLK, at which the value of the modulating jetting signal DATA changes). Accordingly, the value of the signal ADOUT which is outputted from the demodulator circuit 154 corresponding to the value of the demodulation clock DACLK when the signal CONV has been inputted, corresponds to the modulating jetting signal DATA.

The reference clock CLK is inputted to the edge detecting circuit 153, and (the edge detecting circuit 153) outputs a signal WR which indicates that the value of the reference clock CLK has changed, when the value of the reference clock CLK has changed. The latching circuit 155, when the signal WR has been inputted, outputs SIN 0, SIN 1, and SIN 2 corresponding to the signal ADOUT which has been inputted from the demodulator circuit 154, to the register 62.

In this manner, in the second embodiment, it is possible to transfer the modulating jetting signal DATA corresponding to the ink jetting signals SIN 0, SIN 1, and SIN 2 of three bits every time whenever the value of the reference clock CLK changes, from the control unit 110 to the demodulator 141 (driver IC). Therefore, as compared to a case of just transferring the jetting signal as it is, every time whenever the value of the reference clock CLK changes, it is possible to transfer a large number of signals from the control unit 110 to the demodulator 141 (driver IC) without increasing the frequency of the reference clock, or increasing the number of signal wires. In the second embodiment, a unit in which the modulator 111 and the demodulator 141 are combined corresponds to the data transfer unit of the present invention.

Here, as it has been described above, the reference clock CLK which is inputted to the demodulator 141, being modulated in the FM-modulator circuit 112, a cycle thereof fluctuates within a predetermined range.

Figure 14A:
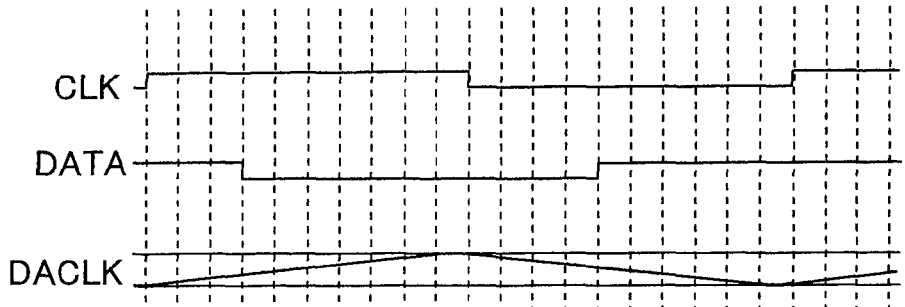
FIG. 14A, FIG. 14B and FIG. 14C are diagrams showing a time change of a value of a reference clock, a demodulating jetting signal, and a modulation clock, when a cycle of the reference clock has fluctuated.
Figure 14B:
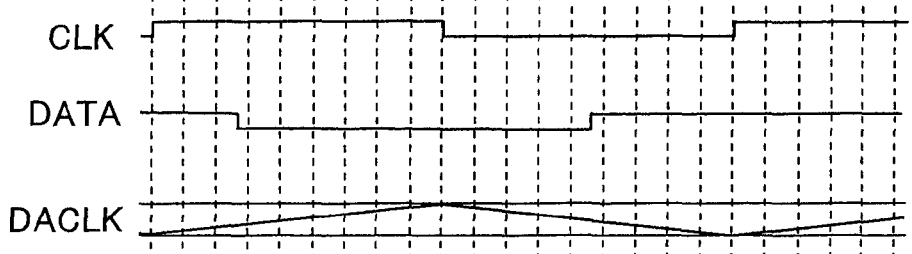
Figure 14C:
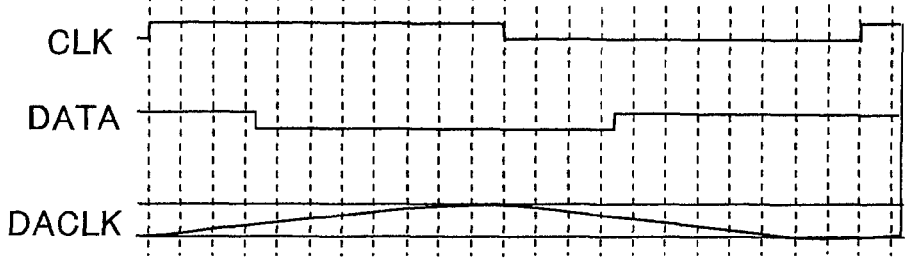

FIG. 14A, FIG. 14B, and FIG. 14C are diagrams showing a time change of CLK when the cycle of the reference clock has fluctuated, the modulating jetting signal DATA, and the demodulation clock DACLK, where, FIG. 14A indicates a case in which the cycle of the reference clock CLK is same as a cycle when generated in the reference-clock generating circuit 58, FIG. 14B indicates a case in which the cycle of the reference clock CLK has become the minimum value in the predetermined range, and FIG. 14C indicates a case in which the cycle of the reference clock CLK has become the maximum value in the predetermined range.

As shown in FIG. 14A, in the case in which the cycle of the reference clock CLK is same as the cycle when generated in the reference-clock generating circuit 58, as it has been described above, when the value of the reference clock CLK has changed from L to H, the value of the demodulation clock DACLK is monotonically increased from the minimum value to the maximum value with time, and after reaching the maximum value, the value of the demodulation clock DACLK is maintained at the maximum value until the value of the reference clock CLK changes from H to L. Moreover, when the value of the reference clock CLK changes from H to L, the value of the demodulation clock DACLK is monotonically decreased from the maximum value to the minimum value with time, and after reaching the minimum value, the value of the demodulation clock DACLK is maintained at the minimum value until the value of the reference clock changes from L to H.

Whereas, in the case in which the cycle of the reference clock CLK is the minimum value in the predetermined range, as shown in FIG. 14B, the value of the reference clock CLK changes from H to L simultaneously as the value of the demodulation clock DACLK reached the maximum value, and the value of the reference clock changes from L to H simultaneously as the value of the demodulation clock DACLK reached the minimum value. Consequently, in this case, after the value of the demodulation clock DACLK has reached the maximum value and the minimum value, the value is not maintained at the maximum value and the minimum value, and increases or decreases immediately.

Whereas, in the case in which the cycle of the reference clock CLK is the maximum value in the predetermined range, as shown in FIG. 14, a period for which the value of the demodulation clock DACLK is maintained at the maximum value and the minimum value, becomes longer as compared to the case in FIG. 14A.

Accordingly, even when the cycle of the reference clock CLK has fluctuated within the predetermined range, before the value of the demodulation clock DACLK is monotonically increased and reaches the maximum value, and before the value of the demodulation clock DACLK is monotonically decreased and reaches the minimum value, the value of the reference clock CLK does not change, and the value of the demodulation clock DACLK changes assuredly from the minimum value to the maximum value, and a change from the maximum value to the minimum value continuously, is repeated.

Consequently, as it has been described above, the signal ADOUT which is outputted from the demodulator circuit 154 according to the value of the demodulation clock DACLK at the timing at which the signal CONV which indicates that the value of the modulating jetting signal DATA has changed, corresponds assuredly to the modulating jetting signal DATA irrespective of the cycle of the reference clock CLK. In other words, it is possible to demodulate the modulating jetting signal DATA assuredly to the corresponding ink jetting signals SIN 0, SIN 1, and SIN 2.

Moreover, unlike in the second embodiment, in a case in which a demodulation multiplying clock DMCLK as described in the first embodiment is used, the demodulation multiplying clock is a clock which is generated from the reference clock CLK of the past, and the demodulation multiplying clock DMCLK which is used for demodulating the modulating jetting signal data is a clock which is generated from the reference clock CLK which is inputted before the reference clock corresponding to the modulating jetting signal DATA. Consequently, when the cycle of the reference clock CLK fluctuates, there is a possibility that the modulating jetting signal DATA cannot be demodulated to the ink jetting signals SIN 0, SIN 1, and SIN 2 accurately.

However, in the second embodiment, since the modulation clock DACLK is a signal for which a timing at which the value of the current reference clock CLK changes is let to be the reference, even when the cycle of the reference clock CLK fluctuates, such problem does not arise, and it is possible to demodulate the modulating jetting signal DATA to the SIN 0, SIN 1, and SIN 2 accurately.

According to the second embodiment described above, the modulator 111 modulates the ink jetting signals SIN 0, SIN 1, and SIN 2 to the modulating jetting signal DATA, and outputs to the demodulator 141. In other words, in the modulator 111, the modulation-clock generating circuit 121 generates alternately an analog waveform of which a value is monotonically increased from the minimum value to the maximum value with time, and of which a value is maintained at the maximum value, until the value of the subsequent reference clock CLK changes after it has reached the maximum value, and an analog waveform of which a value is monotonically decreased from the maximum value to the minimum value with time, and of which the value is maintained at the minimum value, until the value of the subsequent reference clock changes after it has reached the minimum value, and outputs these analog waveforms. Moreover, the modulator circuit 122 outputs the modulating jetting signal of which the value changes at a timing at which the value of the modulation clock MACLK becomes a predetermined value corresponding to the values of the ink jetting signals SIN 0, SIN 1, and SIN 2.

Moreover, the demodulator 141 demodulates the modulating jetting signal DATA to the ink jetting signals SIN 0, SIN 1, and SIN 2 (more appropriately, the signal ADOUT corresponding to the ink jetting signals SIN 0, SIN 1, and SIN 2). In other words, in the demodulator 141, the demodulation-clock generating circuit 151, every time whenever the value of the reference clock CLK changes, generates alternately an analog waveform of which, a value is monotonically increased from the minimum value to the maximum value with a lapse of time, and of which the value is maintained at the maximum value, until the value of the subsequent reference clock CLK changes after it has reached the maximum value, and an analog waveform of which a value is monotonically decreased from the maximum value to the minimum value with time, and of which the value is maintained at the minimum value, until the value of the subsequent reference clock CLK changes after it has reached the minimum value, and outputs these analog waveforms. Moreover, the demodulator circuit 154 outputs the signal ADOUT corresponding to the value of the demodulation clock DACLK when the signal CONV which indicates that the value of the modulating jetting signal DATA has changed, is inputted.

Accordingly, every time whenever the value of the reference clock CLK changes, it is possible to transfer the modulating jetting signal DATA corresponding to the ink jetting signals SIN 0, SIN 1, and SIN 2 of three bits from the control unit 110 to the demodulator 141 (driver IC). Therefore, as conventionally, as compared to a case of just transferring the jetting signal as it is, every time whenever the value of the reference clock CLK changes, it is possible to transfer a large number of signals from the control unit 110 to the demodulator 141 without increasing the frequency of the reference clock CLK or increasing the number of signal wires.

Moreover, by using the constant current sources 131 and 132, the switching circuits 133 and 134, the NOT circuit 135, and the condenser 136, it is possible to form easily the demodulation-clock generating circuit 151 which outputs the demodulation clock DACLK as described above.

Next, modified embodiments in which various modifications are made in the second embodiment will be described below. However, same reference numerals are assigned to components which are similar as in the second embodiment, and description of such components is omitted appropriately.

In the second embodiment, the demodulation-clock generating circuit 151 includes the constant current sources 161 and 162, the switching circuits 163 and 164, the NOT circuit 165, and the condenser 166. However, the demodulation-clock generating circuit 151 is not restricted to include these components, and it may have another circuit configuration provided that the circuit is capable of outputting a waveform similar to the waveform in the second embodiment, as the demodulation-clock DACLK.

In the second embodiment, in the modulation clock and the demodulation clock, the analog waveform in which the value is monotonically increased from the minimum value to the maximum value with time, and the analog waveform in which the value is monotonically decreased from the maximum value to the minimum value with time, during the time period after the value of the reference clock CLK has changed until the value of the reference clock CLK changes subsequently, are repeated alternately every time whenever the value of the reference clock CLK changes. However, waveforms of the modulation clock MACLK and the demodulation clock DACLK are not restricted to these. For instance, only an analog waveform in which the value is monotonically increased from the minimum value to the maximum value with time, during the time after the value of the reference clock CLK has changed until the value of the reference clock CLK changes subsequently may be repeated every time whenever the value of the reference clock CLK changes. Or only an analog waveform in which the value is monotonically decreased from the maximum value to the minimum value with time, during the time after the value of the reference clock CLK has changed until the value of the reference clock CLK changes subsequently may be repeated every time whenever the value of the reference clock CLK changes.

Moreover, in the first embodiment and the second embodiment, by modulating the ink jetting signals SIN 0, SIN 1, and SIN 2 of three bits, the modulating jetting signal DATA has been generated. However, the jetting signal to be modulated may be of two bits or of four bits or more.

Moreover, the modulator and the demodulator are not restricted to the modulators and the demodulators described in the first embodiment and the second embodiment. In other words, the modulator may have another configuration, provided that, the modulator includes a modulation-clock generating circuit which generates a modulation clock from the reference clock CLK, and a modulator circuit which modulates the ink jetting signals SIN 0, SIN 1, and SIN 2 to a plurality of types of modulating jetting signals DATA in which the timing, based on the reference clock CLK, at which a value thereof changes are different mutually, by using the modulation clock. Whereas, the demodulator may have another configuration, provided that, the demodulator includes a demodulation-clock generating circuit which generates from the reference clock CLK, a demodulation clock which is capable of detecting timing, based on the reference clock CLK, at which the value thereof changes, and a demodulator circuit which demodulates the modulating jetting signal DATA to the ink jetting signals SIN 0, SIN 1, and SIN 2 by detecting the timing at which the value of the modulating jetting signal DATA changes, by using the demodulation clock.

The embodiments and the modified embodiments described above are examples in which the demodulator and the data transfer unit of the present invention are applied to an ink-jet head of an ink jet printer. However, the present invention is not restricted to such application, and is also applicable to a recording head in which a large number of elements are lined as in an LED printing head.

What is claimed is:

1. A demodulator for recording head comprising:

a reference-clock input section to which a reference clock is inputted;

a modulated-signal input section to which a plurality of types of modulated signals generated by modulating a plurality of types of recording signals corresponding to a plurality of types of jetting modes of the recording head are inputted;

a demodulation-clock generating circuit which generates from the reference clock, a demodulation clock for detecting the timing at which the value of the modulated signal changes; and a demodulator circuit which demodulates the modulated signal to the recording signal by detecting the timing, at which the value of the modulated signal changes, by using the demodulation clock, wherein the plurality of types of modulated signals have different timings, based on the reference clock, at which values of the modulated signals change, respectively.

2. The demodulator for recording head according to claim 1, wherein the recording head has a nozzle, and is an ink-jet head which jets an ink from the nozzle, and the plurality of types of recording signals correspond to a plurality of types of jetting modes of inks.

3. The demodulator for recording head according to claim 2, wherein the plurality of types of recording signals are composed of two bits or more respectively.

4. The demodulator for recording head according to claim 2, wherein the demodulation-clock generating circuit generates the demodulation clock by multiplying the reference clock, and the demodulator circuit detects the timing at which the value of the modulated signal has changed according to the number of times for which a value of the demodulation clock has changed during a period of time since a value of the reference clock has changed until the value of the modulated signal changes.

5. The demodulator for recording head according to claim 2, wherein the demodulation-clock generating circuit generates an analog waveform in which a value is monotonically increased or is monotonically decreased with time during a period of time since a value of the reference clock has changed until the value of the reference clock changes subsequently as the demodulation clock, and the demodulator circuit detects the timing at which the value of the modulated signal has changed by detecting a value of the demodulation clock at the timing at which the value of the modulated signal has changed.

6. The demodulator for recording head according to claim 5, wherein a cycle of the reference clock fluctuates within a predetermined range, and even when the cycle of the reference clock is any cycle within the predetermined range, the value of the analog waveform is monotonically increased from a minimum value to a maximum value, or is monotonically decreased from the maximum value to the minimum value during the period of time since the value of the reference clock has changed until the value changes subsequently, and the maximum value or the minimum value is maintained until the value of the reference clock changes subsequently.

7. The demodulator for recording head according to claim 5, wherein the demodulation-clock generating circuit includes a first constant current source which is capable of supplying a predetermined constant electric current to an output terminal of the demodulation-clock generating circuit, a second constant current source which is capable of supplying a constant electric current having a direction opposite to a direction of the constant electric current supplied by the first constant current source to an output terminal of the demodulation-clock generating circuit, a first switch which switches conduction and interrupt between the first constant current source and the output terminal, a second switch which switches conduction and interrupt between the second constant current source and the output terminal, and a condenser which is connected between the output terminal and a ground terminal, and whenever the value of the reference clock changes, the first and second switches switch alternately a first state in which the first switch brings the first constant current source and the output terminal in conduction and the second switch interrupts the conduction between the second constant current source and the output terminal, and a second state in which the first switch interrupts the conduction between the first constant current source and the output terminal and the second switch brings the second constant current source and the output terminal in conduction.

8. A data transfer unit for recording head comprising:

a modulator which modulates a plurality of types of recording signals corresponding to a plurality of types of recording modes of a recording head to a plurality of types of modulated signals; and a demodulator which demodulates the modulated signals modulated in the modulator to the recording signals, wherein the modulator has a modulation-clock generating circuit which generates a modulation clock from a reference clock, and a modulation circuit which modulates the plurality of types of recording signals to a plurality of types of modulated signals having different timings, based on the reference clock, at which values of the modulated signals change, by using the modulation clock, and the demodulator has a demodulation-clock generating circuit which generates a demodulation clock for demodulating the modulated signal from the reference clock, and a demodulation circuit which demodulates the modulated signal to the recording signal by detecting a timing, at which a value of the modulated signal changes, using the demodulation clock.

9. The data transfer unit for recording head according to claim 8, wherein the recording head has a nozzle, and is an ink-jet head which jets an ink from the nozzle, and the plurality of types of recording signals correspond to a plurality of types of jetting modes of inks.

10. The data transfer unit for recording head according to claim 9, wherein the modulation-clock generating circuit generates a modulation clock by multiplying the reference clock, and the demodulation-clock generating circuit generates a demodulation clock by multiplying the reference clock.

11. The data transfer unit for recording head according to claim 10, wherein the modulator circuit modulates each of the plurality of types of recording signals to a modulated signal in which a value changes at a timing at which a value of the modulation clock has changed for a predetermined number of times corresponding to a value of the recording signal after the value of the reference clock has changed, and the demodulator circuit detects the timing at which the value of the modulated signal has changed according to the number of times for which a value of a demodulation clock has changed during a period of time since a value of the reference clock has changed until the value of the modulated signal changes.

12. The data transfer unit for recording head according to claim 9, wherein the modulation-clock generating circuit generates an analog waveform in which a value is monotonically increased or is monotonically decreased with time during a period of time since a value of the reference clock has changed until the value of the reference clock changes subsequently as the modulation clock, and the demodulation-clock generating circuit generates an analog waveform in which a value is monotonically increased or is monotonically decreased with time during a period of time since a value of the reference clock has changed until the value of the reference clock changes subsequently as the demodulation clock.

13. The data transfer unit for recording head according to claim 12, wherein the modulator circuit modulates each of the plurality of types of recording signals to a modulated signal in which a value changes at a timing at which a value of the modulation clock has become a predetermined value corresponding to a value of the recording signal after the value of the reference clock has changed, and the demodulator circuit detects the timing at which the value of the modulated signal has changed by detecting a value of the demodulation clock at the timing at which the value of the modulated signal has changed.

14. A recording apparatus comprising:

the data transfer unit for recording head as defined in claim 8; and a recording head for recording based on the recording signals modulated and demodulated in the data transfer unit.

* * * * *